US007346182B2

(12) United States Patent
Sato et al.

(10) Patent No.: US 7,346,182 B2
(45) Date of Patent: Mar. 18, 2008

(54) ELECTROACOUSTIC TRANSDUCER AND METHOD FOR MANUFACTURING THE SAME

(75) Inventors: Tomoyuki Sato, Shizuoka (JP); Yoshio Imahori, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 649 days.

(21) Appl. No.: 10/446,856

(22) Filed: May 29, 2003

(65) Prior Publication Data

US 2004/0042633 A1 Mar. 4, 2004

(30) Foreign Application Priority Data

Jun. 13, 2002 (JP) ..... P2002-172189

(51) Int. Cl.
*H04R 25/00* (2006.01)

(52) U.S. Cl. ..... 381/396; 381/398; 381/409; 381/410

(58) Field of Classification Search ..... 381/396, 381/398, 400, 409, 410, 412, 430, 189, 391, 381/394, 401

See application file for complete search history.

(56) References Cited

U.S. PATENT DOCUMENTS

| | | | | |
|---|---|---|---|---|
| 6,400,825 | B1 * | 6/2002 | Miyamoto et al. | 381/409 |
| 6,674,872 | B2 * | 1/2004 | Fujinami et al. | 381/409 |

FOREIGN PATENT DOCUMENTS

| | | | |
|---|---|---|---|
| JP | 60-58799 | A | 4/1985 |
| JP | 2000-509934 | A | 8/2000 |
| WO | WO 98/38832 | A1 | 9/1998 |

* cited by examiner

*Primary Examiner*—Huyen Le
(74) *Attorney, Agent, or Firm*—Sughrue Mion, PLLC

(57) ABSTRACT

A diaphragm subassembly comprises a voice coil, a diaphragm, a frame, and a pair of terminal members. A magnetic circuit unit comprises a yoke, a magnet, and a base. The diaphragm subassembly and the magnetic circuit unit are accommodated in a bottomed cylindrical cover. In the manufacturing process, the cover is placed with the open end directed upward. The diaphragm subassembly, the yoke, the magnet, and the base are dropped into the cover in this order. The manufacturing process of a dynamic electroacoustic transducer is thereby simplified.

5 Claims, 6 Drawing Sheets

ELECTROACOUSTIC TRANSDUCER AND METHOD FOR MANUFACTURING THE SAME

BACKGROUND OF THE INVENTION

1. Field of the Invention

The present invention relates to a dynamic electroacoustic transducer and a method for manufacturing the same.

2. Description of the Related Art

A dynamic electroacoustic transducer such as a speaker and a microphone generally comprises a diaphragm, a voice coil fixed to the diaphragm at one end, and a magnetic circuit unit having a cylindrical magnetic gap formed therein for accommodating the other end of the voice coil.

In such a conventional electroacoustic transducer, a pair of terminal members is mounted on a frame for supporting the diaphragm, and lead wires drawn from the voice coil are electrically fixed to the terminal members. The voice coil, the diaphragm, the frame and the pair of terminal members are pre-assembled into a diaphragm subassembly.

Such conventional structure, however, has the following problem.

In this kind of electroacoustic transducer, a protective cover with a sound emission hole is provided so as to cover the diaphragm to prevent an unintentional contact of a finger or an object thereto. In the manufacturing process, the magnetic circuit unit and the cover are assembled with respect to the frame from the opposite ends respectively. Therefore, the diaphragm subassembly needs be reversed during the assembly process. This complicates the manufacturing process of the electroacoustic transducer.

SUMMARY OF THE INVENTION

An object of the present invention is to provide an electroacoustic transducer and a manufacturing method for the same, particularly a dynamic electroacoustic transducer and a manufacturing method that simplifies the manufacturing process.

The present invention achieves the object by providing a cover of inventive structure.

The present invention provides an electroacoustic transducer comprising: a diaphragm having a voice coil attached thereto at the end of the voice coil; a frame for supporting the diaphragm at the periphery thereof; a pair of terminal members supported by the frame, the pair of terminal members having lead wires drawn from the voice coil electrically fixed thereon; a magnetic circuit unit having a cylindrical magnetic gap formed therein, the cylindrical magnetic gap accommodating the other end of the voice coil; and a cover provided with a sound emission hole and disposed so as to cover the diaphragm. The voice coil, the diaphragm, the frame and the pair of terminal members constitute a diaphragm subassembly; the cover is a bottomed cylindrical member; and the diaphragm subassembly and the magnetic circuit unit are accommodated in the cover.

The present invention also provides a manufacturing method for an electroacoustic transducer comprising a diaphragm having a voice coil attached thereto at the end of the voice coil; a frame for supporting the diaphragm at the periphery thereof; a pair of terminal members supported by the frame, the pair of terminal members having lead wires drawn from the voice coil electrically fixed thereon; a magnetic circuit unit having a cylindrical magnetic gap formed therein, the cylindrical magnetic gap accommodating the other end of the voice coil; and a cover provided with a sound emission hole and disposed so as to cover the diaphragm. The manufacturing method comprises pre-assembling the voice coil, the diaphragm, the frame and the pair of terminal members into a diaphragm subassembly; forming the cover in the shape of a bottomed cylinder; and inserting the diaphragm subassembly and the magnetic circuit unit in this order from an open end of the cover into the cover to be fixed thereto.

The "electroacoustic transducer" is not limited to a particular structure as far as it is a dynamic electroacoustic transducer. It may be a speaker, a buzzer, a microphone, and a receiver, for example.

The "diaphragm" is not limited to a particular structure as far as it is applicable in the dynamic electroacoustic transducer.

The "voice coil" is not limited to a particular structure as far as it is applicable in the dynamic electroacoustic transducer.

The "magnetic circuit unit" is not limited to a particular structure as far as it is applicable in the dynamic electroacoustic transducer.

The "cover" is a bottomed cylindrical member, having a sound emission hole. The cylindrical shape and the material thereof is not limited to a particular one as far as it is adapted to accommodate the diaphragm subassembly and the magnetic circuit unit. The "cover" may entirely accommodate the diaphragm subassembly and the magnetic circuit unit, or may partly accommodate them with part of them exposed or protruded outside.

In the electroacoustic transducer of this invention, the voice coil, the diaphragm, the frame, and the pair of terminal members constitute the diaphragm subassembly, and the diaphragm subassembly is accommodated in the bottomed cylindrical cover together with the magnetic circuit unit.

Since the diaphragm subassembly and then the magnetic circuit unit are inserted into the cover in this order, the diaphragm subassembly need not be reversed during the assembling process. This simplifies the manufacturing process of the electroacoustic transducer.

Further, in the electroacoustic transducer of this invention, the frame comprises a substantially ring-shaped diaphragm supporting portion and a terminal member supporting portion projecting outward from the diaphragm supporting portion; the external appearance of the magnetic circuit unit is substantially cylindrical and the outer diameter thereof is substantially equal to that of the diaphragm supporting portion; the cover comprises a substantially cylindrical side wall, and the inner diameter thereof is substantially equal to the outer diameter of the diaphragm supporting portion; and the side wall has an opening to allow the terminal member supporting portion to project outward from the side wall.

The cover is thereby made compact in overall dimensions, which contributes to a reduction of the electroacoustic transducer in size. The cover is also made simple in shape, so a metallic press molded cover is available. Compared to an injection molded cover of synthetic resin, the metallic press molded cover can be reduced in thickness, which contributes to a further reduction of the electroacoustic transducer in size.

The magnet, the yoke, and the base may be pre-assembled into the magnetic circuit unit and then inserted into the cover, but it would require a jig to secure a predetermined cylindrical magnetic gap in the pre-assembling process.

Therefore, in this invention, the magnetic circuit unit comprises a magnet disposed at the outside of the voice coil, a yoke attached to one surface of the magnet and constituting an outer surface of the cylindrical magnetic gap, and a base attached to the other surface of the magnet and constituting an inner surface of the cylindrical magnetic gap; and the magnet, the yoke, and the base have an outer diameter substantially equal to each other. The yoke, the magnet, and the base constituting the magnetic circuit unit are separately inserted into the cover in this order while a predetermined cylindrical magnetic gap is maintained. This eliminates a need for an assembling jig and further simplifies the manufacturing process.

The method of inserting the diaphragm subassembly, the yoke, the magnet, and the base into the cover is not limited, but the cover is preferably placed with the open end directed upward. The diaphragm subassembly, the yoke, the magnet, and the base are dropped into the cover in this order. This further simplifies the manufacturing process.

Japanese publication, JP-A-2000-509934, shows an electroacoustic transducer comprising a magnetic circuit unit having a magnet at the outside of the voice coil, but it never discloses the diaphragm subassembly of the above structure.

DETAILED DESCRIPTION OF THE INVENTION

The present invention will be described below in detail with reference to the accompanying drawings.

Figure 1:
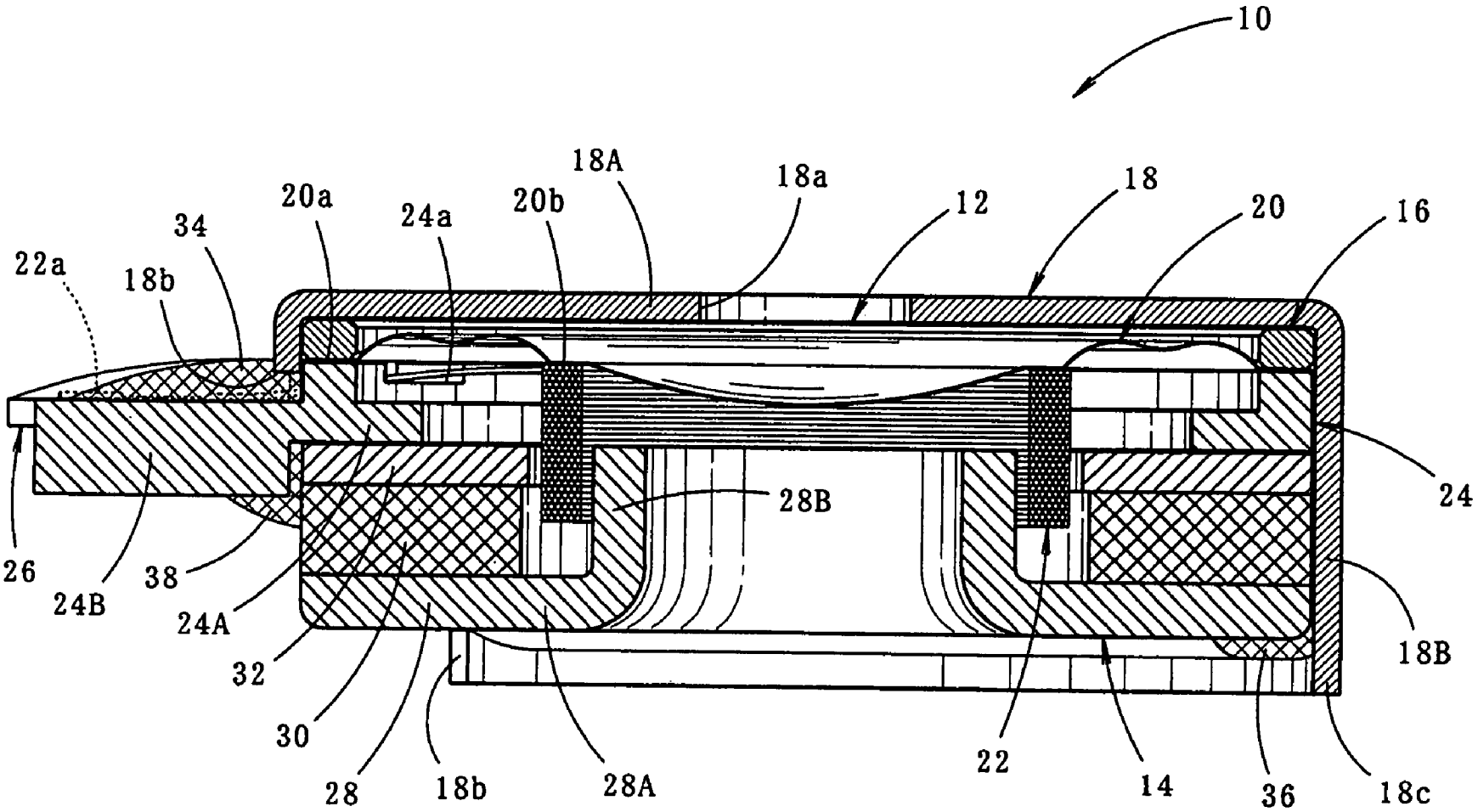
FIG. 1 is a side sectional view of an electroacoustic transducer of the present invention with the front side directed upward.
Figure 2:
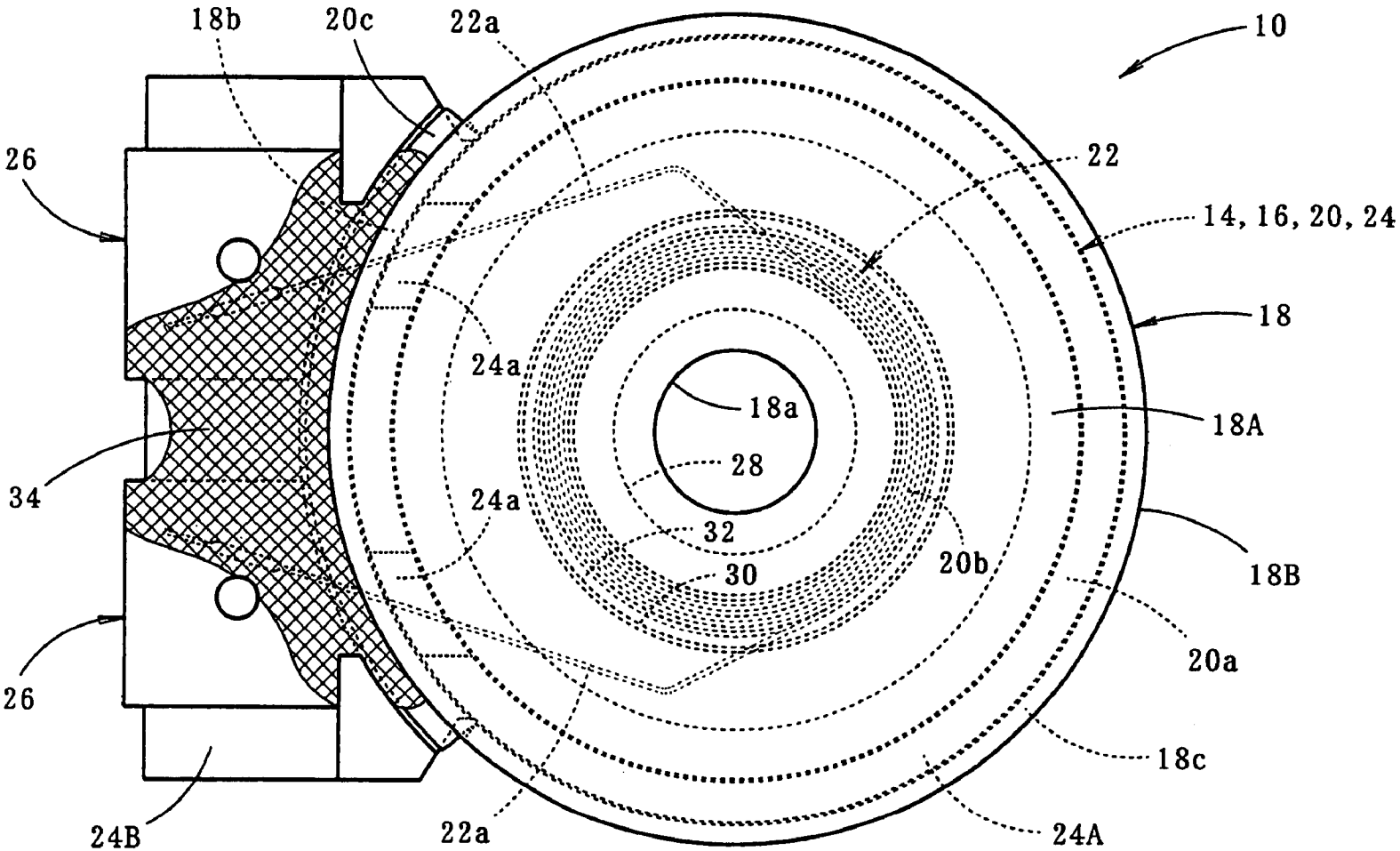
FIG. 2 is a plan view of the electroacoustic transducer.
Figure 3:
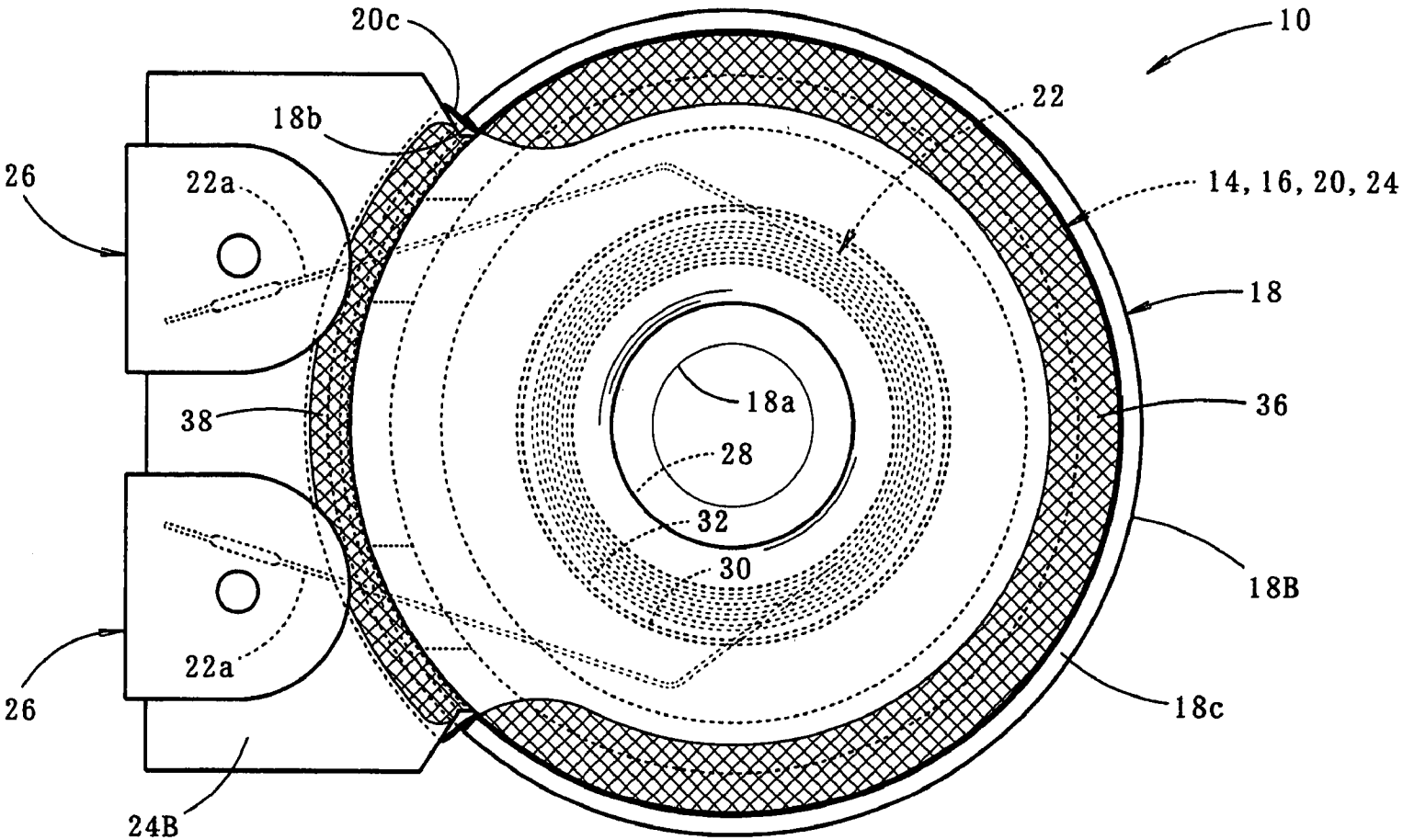
FIG. 3 is a bottom view of the electroacoustic transducer.

FIG. 1 is a side sectional view of an embodiment of an electroacoustic transducer of the present invention with the front side directed upward. FIG. 2 is a plan view and FIG. 3 is a bottom view thereof.

As shown in these drawings, the electroacoustic transducer 10 of the present invention is a miniature dynamic speaker that is adapted to be mounted on a printed circuit board of electronic equipment such as a mobile phone.

The electroacoustic transducer 10 comprises a diaphragm subassembly 12, a magnetic circuit unit 14, a spacer ring 16, and a cover 18.

Figure 4:
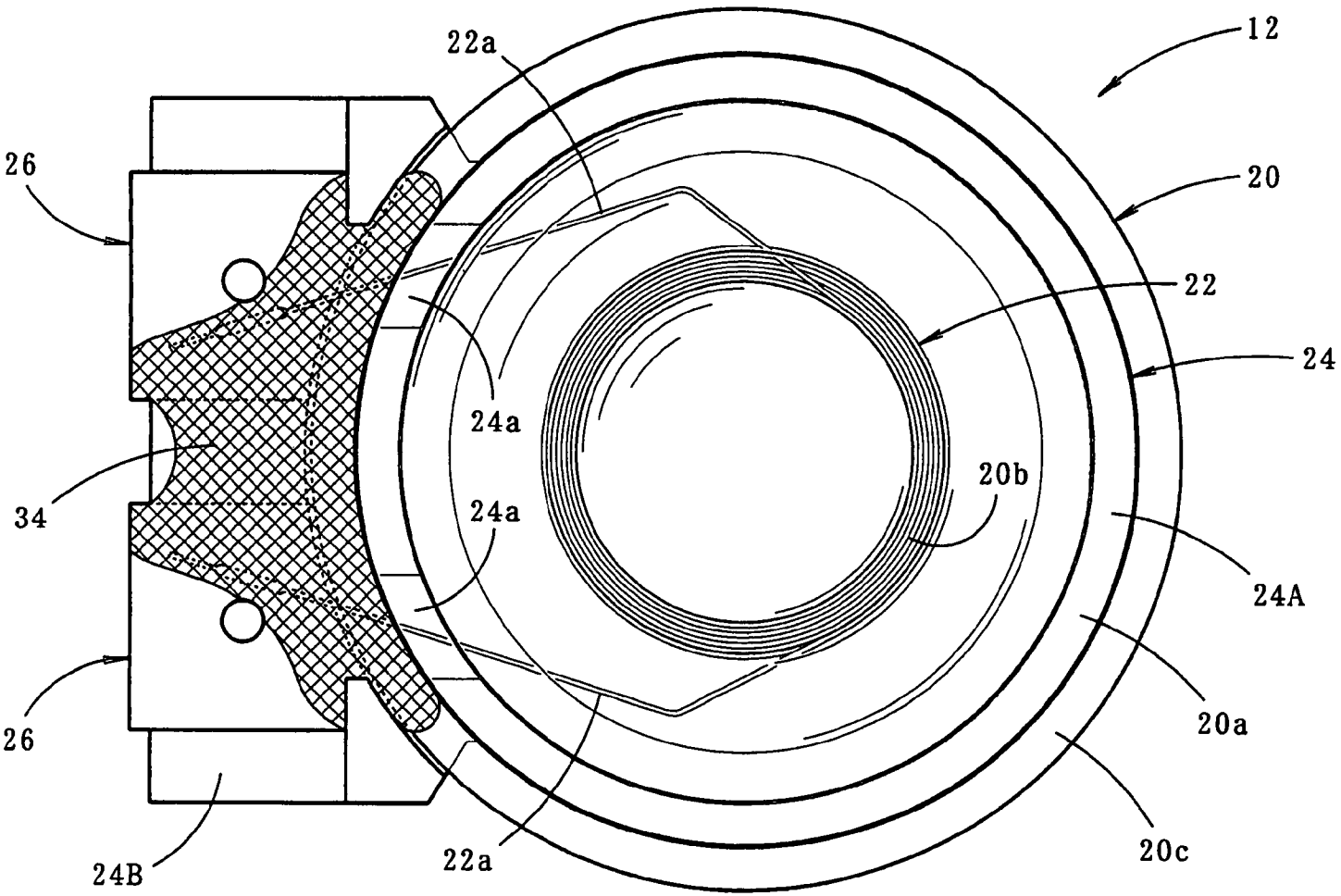
FIG. 4 is a plan view of a diaphragm subassembly.

FIG. 4 is a plan view of the diaphragm subassembly 12.

The diaphragm subassembly 12 comprises a diaphragm 20, a voice coil 22, a frame 24, and a pair of terminal members 26.

The diaphragm 20 is made of synthetic resin film by thermal press molding, having a plurality of irregularity concentric to each other. There are formed a peripheral flat portion 20*a* and an intermediate flat portion 20*b*. The diaphragm 20 is mounted to the frame 24 at the peripheral flat portion 20*a* and bonded to the upper end of the voice coil 24 at the intermediate flat portion 20*b*.

The frame 24 comprises a ring-shaped diaphragm supporting portion 24A having an outer diameter of 10 mm or less (8 mm for example), and a terminal member supporting portion 24B projecting outward from the diaphragm supporting portion 24A. The peripheral flat portion 20*a* of the diaphragm 20 is supported on the diaphragm supporting portion 24A. The pair of terminal members 26 are supported on the terminal member supporting portion 24B.

Each terminal member 26 is the shape of a plate and integrally formed with the frame 24 by insert molding. A lead wire 22*a* drawn from the voice coil 22 is electrically fixed on the upper surface of the terminal member 26 by, for example, thermal pressing.

The diaphragm supporting portion 24A of the frame 24 is the sectional shape of a letter "L", having a pair of recesses 24*a* formed near the terminal members 26 in order to allow the lead wires 22*a* to be passed thereon. An overcoat 34 is applied on the terminal member supporting portion 24B to cover the lead wires 22*a* fixed on the terminal members 26.

The magnetic circuit unit 14 comprises a steel base 28, a magnet 30, and a steel yoke 32.

The base 28 comprises a ring-shaped flat portion 28A and a flange 28B extending upward from the inner circumference of the ring-shaped flat portion 28A. The magnet 30 is ring-shaped and concentrically adhered to the upper surface of the ring-shaped flat portion 28A of the base 28. The inner diameter of the magnet 30 is larger than the outer diameter of the flange 28B by a predetermined dimension. The yoke 32 is ring-shaped and concentrically adhered to the upper surface of magnet 30. The inner diameter of the yoke 32 is slightly smaller than the inner diameter of the magnet 30. The outer diameter of the base 28, the magnet 30, or the yoke 32 is substantially equal to the outer diameter of the diaphragm supporting portion 24A of the frame 24.

The magnetic circuit unit 14 is substantially concentrically arranged with respect to the diaphragm supporting portion 24A in a manner that the upper surface of the yoke 32 is engaged with the lower surface of the diaphragm supporting portion 24A. A cylindrical magnetic gap is thereby formed between the inner surface of the yoke 32 and the outer surface of the flange 28B of the base 28, having the same width over the entire circumference so as to accommodate a lower portion of the voice coil 22 in the gap.

The cover 18 is press molded of metal such as aluminum, having the shape of a bottomed cylinder. It is mounted so as to cover the diaphragm 20 from above.

The cover 18 comprises a bottom wall 18A and a side wall 18B. A sound emission hole 18*a* is formed at the center of the bottom wall 18A. The side wall 18B is cylindrically shaped, and the inner diameter thereof is substantially equal to (slightly larger than) the outer diameter of the diaphragm supporting portion 24A. There is also formed on the side wall 18B a rectangular opening 18*b* through which the terminal supporting portion 24B is protruded outside.

The spacer ring 16 has an outer diameter substantially equal to the outer diameter of the diaphragm supporting portion 24A. The ring 16 is interposed between the peripheral flat portion 20*a* and the bottom wall 18A so that it may prevent interference of the diaphragm 20 with the cover 18.

In this embodiment, the diaphragm subassembly 12 and the magnetic circuit unit 14 are accommodated in the cover 18 together with the spacer ring 16. The side wall 18B of the cover 18 is set to an appropriate value in height so that an open end 18C of the cover 18 extends slightly lower than the lower surface of the magnetic circuit unit 14.

The manufacturing process of the electroacoustic transducer 10 of the embodiment is being described.

As shown in FIG. 4, the voice coil 22, the diaphragm 20, the frame 24, and the pair of terminal members 26 are pre-assembled together into the diaphragm subassembly 12. The diaphragm 20 has a flange 20*c* in the shape of a letter "L" formed as the result of the molding procedure of the diaphragm 20.

Figure 5:
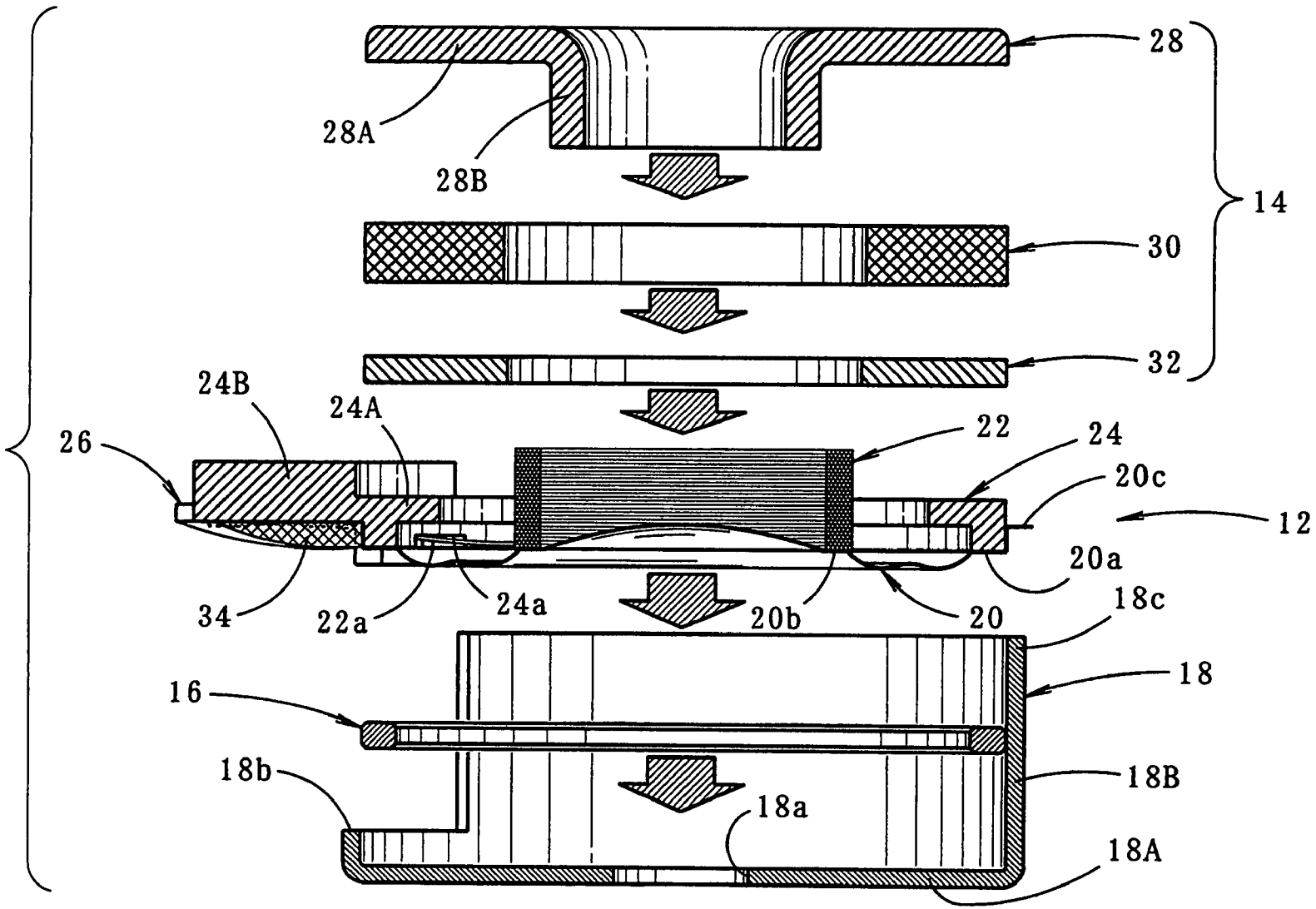
FIG. 5 is a side sectional view showing the manufacturing process.

As shown in FIG. 5, the cover 18 is placed with the open end 18*c* directing upward. The spacer ring 16, the diaphragm subassembly 12, the yoke 32, the magnet 30, and the base 28 are dropped into the cover 18 in this order.

The outer diameter of the spacer ring 16, the yoke 32, the magnet 30, or the base 28 is substantially equal to the outer diameter of the diaphragm supporting portion 24A. The outer diameter of the diaphragm supporting portion 24A is substantially equal to (slightly smaller than) the inner diameter of the side wall 18B of the cover 18. Therefore, the spacer ring 16, the diaphragm subassembly 12, the yoke 32, the magnet 30, and the base 28 are only dropped inside the cover 18 while they are positioned substantially concentric to each other.

Further, the spacer ring 16, the yoke 32, the magnet 30, and the base 28 are free from any directional requirement when they are dropped into the cover 18. Only the diaphragm subassembly 12 need be oriented so that the terminal member supporting portion 24B may be engaged with the opening 18*b* of the cover 18. When the diaphragm subassembly 12 is dropped into the cover 18, the "L" flange 20*c* of the diaphragm 20 except the portion opposite the upper surface of the terminal supporting portion 24B is bent by engagement with the open end 18*c* of the cover 18.

Once the above elements are dropped in the cover 18, an adhesive agent 36 is applied to the base 28 along the outer periphery of the ring-shaped flat portion 28A. The base 28 is thereby fixed to the side wall 18B. Further, an adhesive agent 38 is applied to the frame 24 along the inner periphery of the terminal member supporting portion 24B. The yoke 32 and the magnet 30 are thereby fixed to the terminal member supporting portion 24B.

In this embodiment, as described above, the voice coil 22, the diaphragm 20, the frame 24, and the pair of terminal members 26 are pre-assembled into the diaphragm subassembly 12, and the diaphragm subassembly 12 is accommodated in the bottomed cylindrical cover 18 together with the magnetic circuit unit 14.

The diaphragm subassembly 12 and then the magnetic circuit unit 14 are inserted from the open end 18*c* into the cover 18 in this order. The diaphragm subassembly 12 need not be reversed, which simplifies the manufacturing process of the electroacoustic transducer 10.

In this embodiment, as described above, the frame 24 comprises the substantially ring-shaped diaphragm supporting portion 24A and the terminal member supporting portion 24B projecting outward from the diaphragm supporting portion 24A. The external appearance of the magnetic circuit unit 14 is substantially cylindrical, and the outer diameter thereof is substantially equal to the outer diameter of the diaphragm supporting portion 24A. The cover 18 has the substantially cylindrical side wall 18B, and the inner diameter thereof is substantially equal to the outer diameter of the diaphragm supporting portion 24A. The side wall 18B has the opening 18*b* to allow the terminal member supporting portion 24B to protrude outward.

The cover 18 is thereby made compact in overall dimensions. This contributes to a reduction of the electroacoustic transducer 10 in size. The cover 18 is also made simple in shape, so a metallic press molded cover is available. Compared to an injection molded synthetic resin cover, the metallic press molded metal cover can be reduced in thickness, which contributes to a further miniaturization of the electroacoustic transducer 10.

In this embodiment, as described above, the magnetic circuit unit 14 has the magnet 30 positioned outside with respect to the voice coil. Since the outer diameter of the yoke 32, the magnet 30, and the base 28 is substantially equal to each other, they are positioned within the cover 18 concentrically to each other when they are dropped into the cover 18 in this order. They are assembled into the magnetic circuit unit 14 inside the cover 18 with a predetermined cylindrical magnetic gap maintained. This process eliminates the need of an assembling jig, and streamlines the manufacturing process of the electroacoustic transducer 10. Since the magnet 30 is positioned at the outside of the voice coil, the magnetic circuit unit 14 is easily available even when the electroacoustic transducer 10 is reduced in size.

In this embodiment, as described above, the diaphragm subassembly 12, the yoke 32, the magnet 30, and the base 28 are, in this order, dropped in the cover 18 which is placed with the open end 18*c* directed upward. This further simplifies the manufacturing process.

Figure 6:
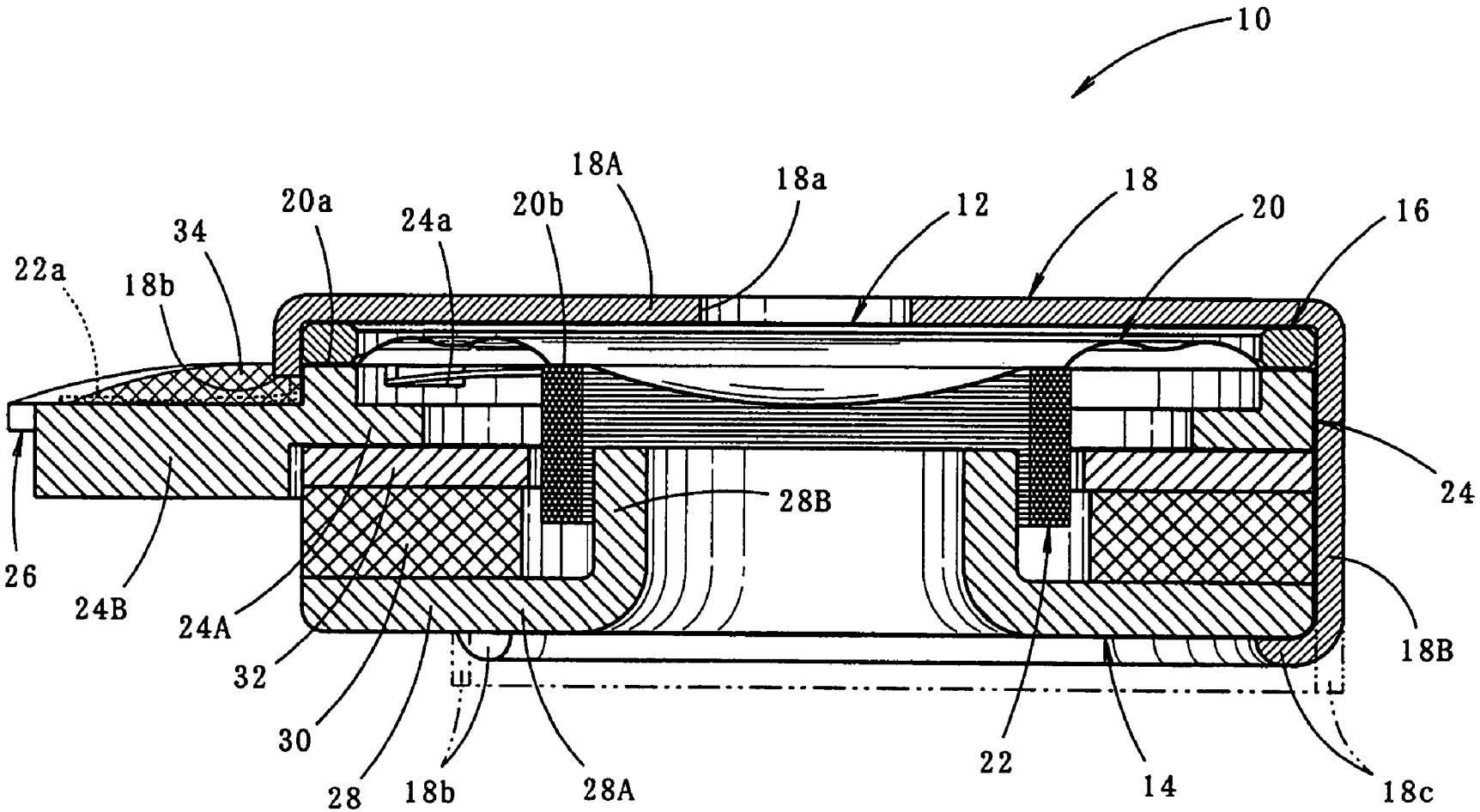
FIG. 6 is a side sectional view of another embodiment of the present invention.

In this embodiment, as described above, the diaphragm subassembly 12 and the magnetic circuit unit 14 are fixed to the cover 18 by applying the adhesive 36 to the outer periphery of the ring-shaped flat portion 28A and by applying the adhesive 38 to the inner periphery of the terminal member supporting portion 24B. Instead, as shown in FIG. 6, the diaphragm subassembly 12, the yoke 32, the magnet 30, and the base 28 are, in this order, dropped in the cover 18, and then the open end 18*c* of the cover 18 may be bent inward to be caulked at the outer periphery of the ring-shaped flat portion 28A of the base 28.

In this embodiment, the diaphragm subassembly 12 and the magnetic circuit unit 14 are accommodated in the cover 18 with the spacer ring 16 inserted inbetween. Instead, the cover 18 may be provided with a stepped portion having the thickness equal to the spacer ring 16 and then the spacer ring 16 may be eliminated.

What is claimed is:

1. An electroacoustic transducer comprising:

a diaphragm having a voice coil attached thereto at the end of the voice coil;

a frame for supporting the diaphragm at the periphery thereof;

a pair of terminal members supported by the frame, the pair of terminal members having lead wires drawn from the voice coil electrically fixed thereon;

a magnetic circuit unit having a cylindrical magnetic gap formed therein, the cylindrical magnetic gap accommodating the other end of the voice coil; and a cover provided with a sound emission hole and disposed so as to cover the diaphragm wherein the voice coil, the diaphragm, the frame and the pair of terminal members constitute a diaphragm subassembly;

the cover is a bottomed cylindrical member; and the diaphragm subassembly and the magnetic circuit unit are accommodated in the cover;

wherein the frame comprises a substantially ring-shaped diaphragm supporting portion and a terminal member supporting portion projecting outward from the diaphragm supporting portion;

the external shape of the magnetic circuit unit is substantially cylindrical and the outer diameter thereof is substantially equal to that of the diaphragm supporting portion;

the cover comprises a substantially cylindrical side wall, and the inner diameter thereof is substantially equal to the outer diameter of the diaphragm supporting portion; and the side wall has an opening to allow the terminal member supporting portion to project outward from the side wall.

2. The electroacoustic transducer as claimed in claim 1, wherein the magnetic circuit unit comprises a magnet disposed at the outside of the voice coil, a yoke attached to one surface of the magnet and constituting an outer surface of the cylindrical magnetic gap, and a base attached to the other surface of the magnet and constituting an inner surface of the cylindrical magnetic gap; and the magnet, the yoke, and the base have an outer diameter substantially equal to each other.

3. A manufacturing method for an electroacoustic transducer comprising a diaphragm having a voice coil attached thereto at the end of the voice coil; a frame for supporting the diaphragm at the periphery thereof; a pair of terminal members supported by the frame, the pair of terminal members having lead wires drawn from the voice coil electrically fixed thereon; a magnetic circuit unit having a cylindrical magnetic gap formed therein, the cylindrical magnetic gap accommodating the other end of the voice coil; and a cover provided with a sound emitting hole and disposed so as to cover the diaphragm;

the manufacturing method comprising pre-assembling the voice coil, the diaphragm, the frame and the pair of terminal members into a diaphragm subassembly;

forming the cover in the shape of a bottomed cylinder; and inserting the diaphragm subassembly and the magnetic circuit unit in this order from an open end of the cover into the cover to be fixed thereto;

wherein the frame comprises a substantially ring-shaped diaphragm supporting portion and a terminal member supporting portion projecting outward from the diaphragm supporting portion;

the external shape of the magnetic circuit unit is substantially cylindrical and the outer diameter thereof is substantially equal to that of the diaphragm supporting portion;

the cover comprises a substantially cylindrical side wall, and the inner diameter thereof is substantially equal to the outer diameter of the diaphragm supporting portion; and the side wall has an opening to allow the terminal member supporting portion to project outward from the side wall.

4. The manufacturing method for an electroacoustic transducer as claimed in claim 3, wherein the magnetic circuit unit comprises a magnet disposed at the outside of the voice coil, a yoke attached to one surface of the magnet and constituting an outer surface of the cylindrical magnetic gap, and a base attached to the other surface of the magnet and constituting an inner surface of the cylindrical magnetic gap; and the magnet, the yoke, and the base have an outer diameter substantially equal to each other;

wherein the yoke, the magnet, and the base are inserted in this order into the cover.

5. The manufacturing method for an electroacoustic transducer as claimed in claim 3, wherein the cover is positioned with the open end directed upward, and the diaphragm subassembly, the yoke, the magnet, and the base are dropped in this order into the cover.

* * * * *